US005333828A

United States Patent [19]

Severeid

[11] Patent Number: 5,333,828

[45] Date of Patent: Aug. 2, 1994

[54] FOLDABLE CHRISTMAS TREE STAND

[76] Inventor: Donald R. Severeid, 12512 164th St. East, Puyallup, Wash. 98374

[21] Appl. No.: 879,980

[22] Filed: May 6, 1992

[51] Int. Cl.[5] ..... A47G 33/12

[52] U.S. Cl. ..... 248/519; 248/528; 248/167; 403/83

[58] Field of Search ..... 248/519, 511, 523, 524, 248/527, 528, 167, 188, 529; 47/40.5, 42; 403/83, 84, 85

[56] References Cited

U.S. PATENT DOCUMENTS

| | | | |
|---|---|---|---|
| 280,851 | 7/1883 | Pannsler | 248/524 |
| 904,227 | 11/1908 | Rice . | |
| 960,497 | 6/1910 | Burkart | 248/524 |
| 1,151,745 | 8/1915 | Wagner | 248/524 |
| 1,445,625 | 2/1923 | Junkunc . | |
| 1,642,231 | 9/1927 | Dover | 248/528 X |
| 2,500,215 | 3/1950 | Swearingen . | |
| 2,544,615 | 3/1951 | Raymond | 248/167 X |
| 2,630,286 | 3/1953 | Dieckhoff | 248/523 |
| 2,650,783 | 9/1953 | Stanley . | |
| 2,699,308 | 1/1955 | Shackelford | 248/528 X |
| 2,786,641 | 3/1957 | Applegate | 248/523 |
| 3,045,959 | 7/1962 | Herrington . | |
| 3,295,802 | 1/1967 | Leatherman . | |
| 3,708,144 | 1/1973 | Nasmith | 248/167 |
| 4,254,578 | 3/1981 | Hanfeld | 248/524 X |
| 4,477,049 | 10/1984 | Davis . | |
| 4,699,347 | 10/1987 | Kuhnley . | |
| 5,037,049 | 8/1991 | Funk | 248/167 X |

FOREIGN PATENT DOCUMENTS

| | | |
|---|---|---|
| 141455 | 12/1952 | Fed. Rep. of Germany . |
| 96404 | 5/1960 | Norway . |

*Primary Examiner*—David A. Scherbel
*Assistant Examiner*—Derek J. Berger
*Attorney, Agent, or Firm*—William G. Forster

[57] ABSTRACT

A foldable Christmas tree stand having a plurality of legs that can be permanently assembled, yet is foldable in the assembled form. When unfolded it receives and supports a Christmas tree in an upright position, and when folded it occupies a flat, compact, planar space for convenient handling, storage, and shipping. The Christmas tree stand comprises pivotally interconnected legs that pivot about one or more substantially vertical axes. When unfolded, the legs can be locked in position by a locking assembly disposed about the pivot axes of the pivotally interconnected legs there by providing a stable base for mounting a Christmas tree thereto. Additionally, the Christmas tree stand is designed to enable the trunk of the tree to rest in a water supply container, partially full with water thereby keeping the tree moist to extend the tree's life.

7 Claims, 3 Drawing Sheets

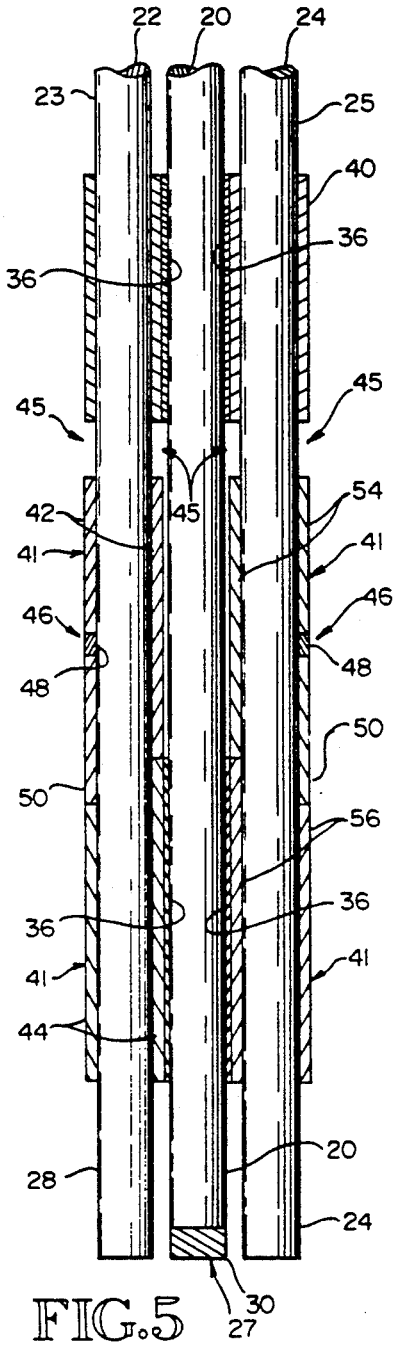
FIG. 5
FIG. 6
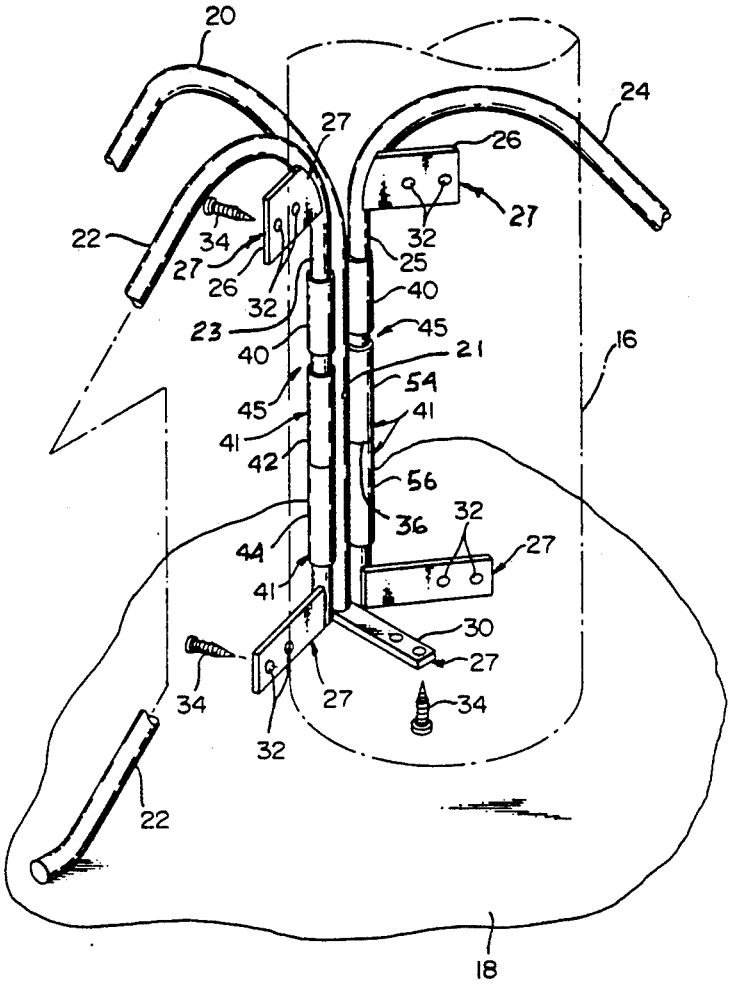
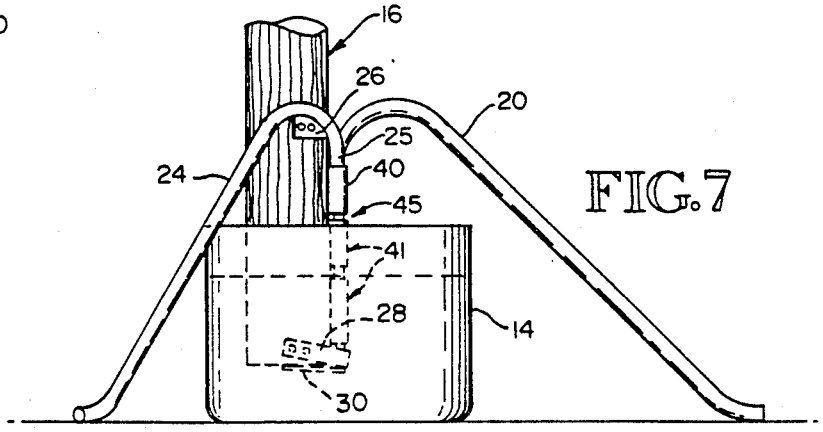
FIG. 7

FOLDABLE CHRISTMAS TREE STAND

BACKGROUND OF THE INVENTION

This invention relates generally to Christmas tree stands, and more particularly to permanently assembled Christmas tree stands that fold to a flat, planer configuration for ease of storage and shipping.

A number of mechanisms have been invented for holding and supporting real and artificial Christmas trees in homes where such trees are displayed. Some of these support mechanisms incorporate features such as collapsing supports for compact storage, unimpeded space under the tree trunk for placement of watering devices, and legs that adjust to correctly set and position the vertical axis of the tree.

Accordingly, several early designs addressed the problem of compact Christmas tree stand storage by having the tree stand legs collapse about .independent axes. For example U.S. Pat. No. 904,227 to Rice incorporated symmetrical tree stand legs that collapse about independent vertical axes. The Rice design, however, requires that the tree trunk be centered in relation to the legs, and in addition, it prevents the tree trunk from extending below the legs of the tree stand. Accordingly, this design makes it impractical for placement of a water source under the tree to feed the same. Similarly, U.S. Pat. No. 1,445,625 to Junkunc U.S., and U.S. Pat. No. 2,500,215 to Swearingen, include legs that pivot about a vertical axis. These designs, like Rice, also require the trunk of the tree to be positioned in the symmetrical center of the stand. This configuration, in turn, requires that the legs either be positioned around the tree trunk such as in Junkunc, or that the legs run under tree trunk, as in Swearingen. Moreover, none of these designs provide a stand that, when assembled, collapses to a flat configuration for ease of storage and shipping.

Other designs such as U.S. Pat. No. 2,650,783 to Stanley, and U.S. Pat. No. 3,045,959 to Herrington disclose legs that collapse about horizontal axes. Although these designs provide space for a watering system below the tree trunk, they share some of the same problems of the above designs: they cannot collapse to a flat planar shape when not in use. Likewise, they are difficult to store or ship.

Finally, designs such as U.S. Pat. No. 4,477,049 to Davis, that illustrates a noncollapsible stand, and U.S. Pat. No. 4,699,347 to Kuhnley, that illustrates a somewhat complicated stand having many movable parts, are impractical for home use.

Accordingly, a need remains for an improved Christmas tree stand that is simple, and that collapses to a flat structure for ease of storage and shipping, inexpensive, easy to install and use, and can readily be adapted to different trees.

SUMMARY OF THE INVENTION

One object of the present invention is to provide an improved Christmas tree stand.

A second object of the invention is to enable a user to fold the Christmas tree stand to a flat planar shape so that it can be easily shipped.

Another object of the invention is to make it easier for one to store the Christmas tree stand when it is not in use.

Yet another object of the invention is to provide a durable, permanently assembled Christmas tree stand having no loose parts wherein its components are not easily separated or lost.

Another object of the invention is to simplify the support of Christmas trees wherein the tree is easily installed and, similarly, easily removed from the stand.

A further object of the invention is to furnish a tree stand that accommodates watering systems disposed around the trunk of the Christmas tree so that the same remains fresh for a longer period.

An additional object of the invention is to make it easier to support Christmas trees having crooked trunks.

Still another object of the invention is to permit easy adjustment of the vertical axis of the tree once the tree is attached to the Christmas tree stand.

The present invention is a foldable Christmas tree stand having a plurality of legs that can be permanently assembled, yet is foldable in the assembled form. When unfolded it supports a Christmas tree in an upright position, and when folded it occupies a compact planar space for convenient handling, storage, and shipping.

Included in the tree stand is at least three supporting legs, each fabricated to be substantially planar in shape. In other words, if laid on a flat surface, most sections or consecutive points along the length of each leg would contact the flat surface. In addition, each leg is pivotally interconnected to the other legs so that the Christmas tree stand can assume either a folded, tree supporting position, or an unfolded, storage position. Moreover, the legs pivot about a substantially vertical axis wherein the axis of the tree is eccentrically disposed to such a vertical axis.

The invention also includes a fastening assembly that comprises a series of fastening lugs that provide a self-centering feature wherein a tree trunk is automatically centered when attached to the Christmas tree stand. The fastener assembly is fixedly attached to two or more of the legs of the Christmas tree stand. A fastener assembly so attached releasably engages a Christmas tree thereby securing the same to the Christmas tree stand. An additional alternate function of the fastener assembly is to lock the legs in the unfolded position when a Christmas tree is so engaged.

A further feature of the present invention is a locking assembly fixedly disposed about at least two of the legs, the locking assembly having a first unlocked position and a second locked position, wherein the locking assembly locks the legs against rotation when the Christmas tree stand is in the unfolded position.

The foregoing and other objects, features, and advantages of this invention will become more readily apparent from the following detailed description of a preferred embodiment which proceeds with reference to the accompanying drawings.

BRIEF DESCRIPTION OF THE DRAWINGS

FIG. 5 is a cross-sectional view taken along line 5—5.

FIG. 6 is a perspective view of a modified Christmas tree stand wherein the locking assembly is removed.

FIG. 7 is an elevational view of a Christmas tree stand supporting a Christmas tree trunk over a water container wherein water in the water container surrounds the tree trunk.

DETAILED DESCRIPTION OF PREFERRED EMBODIMENT

Figure 1:
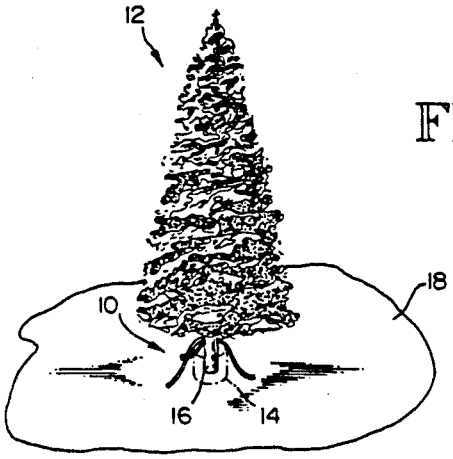
FIG. 1 is a perspective view of a Christmas tree being supported by the Christmas tree stand, wherein a water source is disposed below the base of the Christmas tree.

FIGS. 1 through 7 show a preferred embodiment of a foldable Christmas tree stand 10 in accordance with the invention.

Generally speaking, the foldable Christmas tree stand 10 is designed to support a Christmas tree 12 in a vertical, upright position. While in that position, the trunk of the tree 16 extends downward into a water container 14, that rests on a floor 18. This arrangement permits the trunk 16 to partially submerge in water so that the Christmas tree 12 stays moist and lasts longer. When not in use, the Christmas tree stand 10 folds to a compact planar shape, see FIG. 4, for convenient handling, storage, and shipping.

The preferred embodiment of the Christmas tree stand 12 has three legs 20, 22 and 24 that pivotally interconnect. Each leg is planar in shape, i.e., each leg defines and lies wholly within a single plane; and each leg includes a vertical shaft made of a flexible, material having a round cross section. Included therein is a central leg 20 having a vertical shaft 21; a first side leg 22 located to one side of the central leg 20, the first side leg 22 having a vertical shaft 23; and a second side leg 24 located to one side of the central leg 20, opposite the first side leg 22, the second side leg 24 having a vertical shaft 25. In the present invention, the vertical trunk 16 of a Christmas 16 is releasably attached eccentrically to the vertical shafts 21, 23 and 25.

Figure 3:
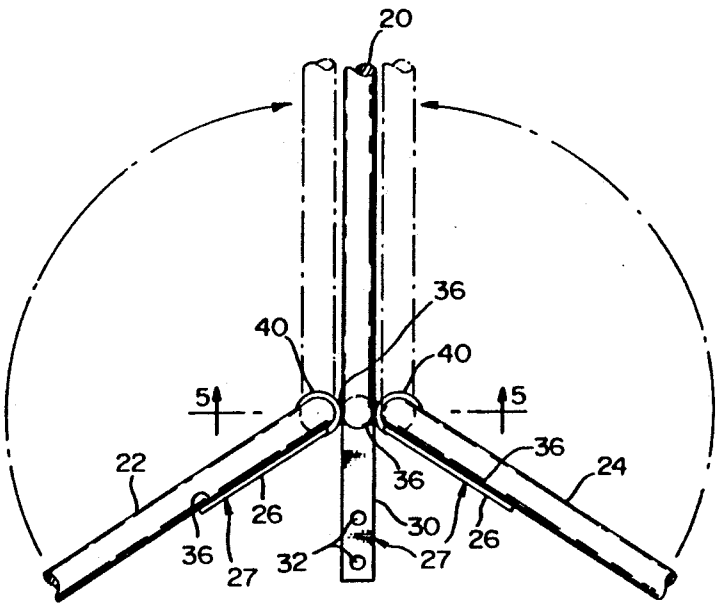
FIG. 3 is a plan view of a Christmas tree stand in the open position with phantom lines illustrating the folded, closed position.
Figure 4:
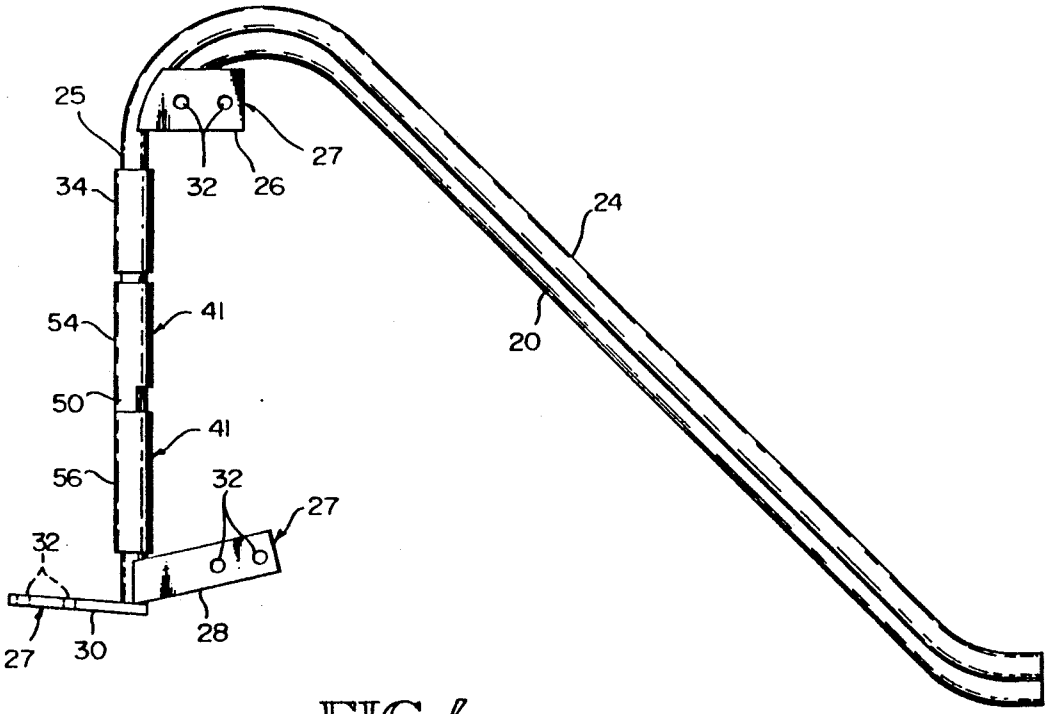
FIG. 4 is an elevational view of a Christmas tree stand in the closed position.

Turning to FIGS. 3 and 4, a Christmas tree stand 10 is illustrated showing the unfolded position FIG. 3, and the folded position FIG. 4. In FIG. 3, the side legs 22 and 24 are pivoted to a symmetrical position about the central leg 20, i.e., the side legs 22 and 24 are pivoted so that the first side leg 22 occupies a position substantially equidistant between the central leg 20 and the second side leg 24, and similarly, the second side leg 24 occupies a position substantially equidistant between the central leg 20 and the first side leg 22. This, unfolded position provides a solid base for support of a Christmas tree 12.

When the Christmas tree stand 10 is not in use, it folds to a planar shape for storage as illustrated in FIG. 4. To achieve the folded position the first side leg 22 pivots clockwise until it abuts the central leg, and the second side leg 24 pivots counterclockwise until it similarly abuts the central leg 20. Thus, in the folded position, the side legs 22 and 24 pivot so that all the legs 20, 22 and 24 are positioned side by side, i.e., all the legs 20, 22 and 24 define a substantially common plane.

To facilitate the folding action as noted above, each side leg, 22 and 24, pivots about a substantially vertical axis. The first side leg 22 pivots about an axis defined by its vertical shaft 23, and the second side leg 24 pivots about an axis defined by its vertical shaft 25. As shown in FIGS. 2 through 6, the vertical shafts 21, 23, and 25 of each leg are disposed in parallel adjacent relation. That is, the vertical shaft 23 of the first side leg 22 is parallel to the vertical shaft 21 of the central leg 20, and as illustrated below, is held in close relation to the central leg 20 by sleeves 40, 42 and 44. Similarly, the vertical shaft 25 of the second side leg 24 is parallel to the vertical shaft 21 of the central leg 20, and as illustrated below, is held in close relation to the central leg 20 by sleeves 40, 54 and 56.

Figure 2:
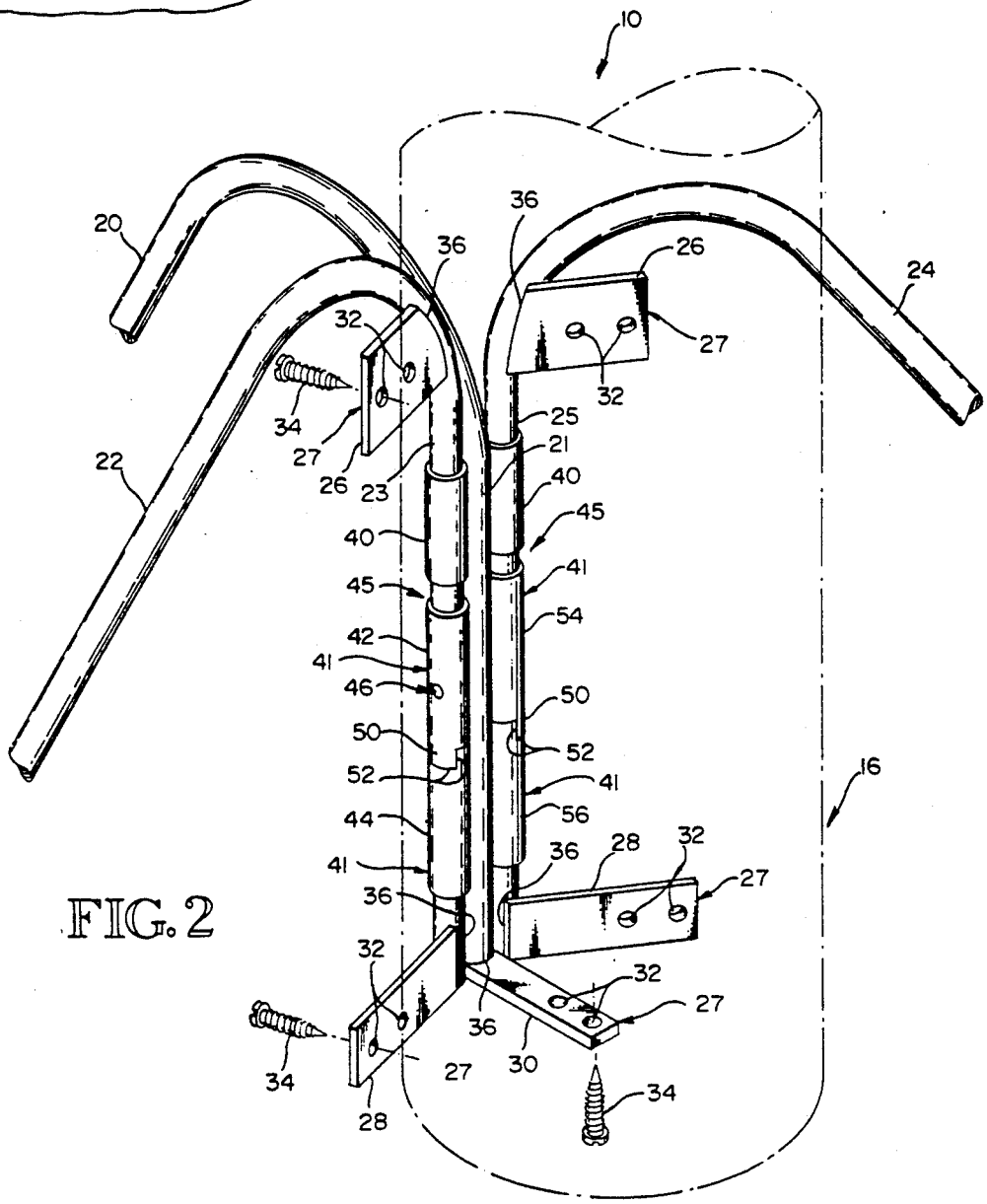
FIG. 2 is a enlarged perspective view of a Christmas tree stand with portions of the legs broken away.

Referring now to FIGS. 1 and 2, a Christmas tree 12 is secured to the tree stand 10 by screws 34 that fasten the tree trunk 16 to a series of lugs that make up the fastener assembly 27. The lugs that embody the fastener assembly 27 are fixedly attached to the legs 20, 22 and 24 of the Christmas tree stand 10 by fillet welds 36. Accordingly, a Christmas tree 12 is secured to the fastener assembly 27 which is itself secured to the tree stand 10.

More specifically, an upper lug 26 and a spaced apart lower lug 28 are attached, by fillet welds 36, to the vertical shafts 23 and 25 of the first and second side legs 22 and 24, i.e., one spaced apart pair of lugs are fixedly attached to shaft 23 of the first side leg 22 and one pair to the shaft 25 of the second side leg 24. Additionally, a bottom lug 30 is attached by a fillet weld 36 on the vertical shaft 21 of the central leg 20. All the above disclosed lugs have two predrilled holes 32 bored therethrough to receive the screws 34 or the like when the tree 12 is fastened to the tree stand 10.

In addition, each of the above disclosed upper and lower lugs 26, 28 are planar in shape, i.e., flat, and are attached so that they lie in substantially the same plane as the plane defined by the leg to which they are attached attached thereto. In this way, when the tree stand 10 is in the folded position, the upper and lower lugs 26, 28 do not project outward or project normal to the plane of the folded stand. Thus, a compact planar shape is achieved when the tree stand 10 is in the folded position.

Referring now to FIGS. 2 through 6, the side legs 22 and 24 are pivotally attached to the central leg 20 by a locking assembly 41 and by guide sleeves 40. More specifically, tubular guide sleeves 40 are co-axially disposed about the upper portion of the tubular vertical shafts 23 and 25 of the side legs 22 and 24. Guide sleeves 40 so disposed are fixedly attached to the central leg 20 by fillet welds 36. This configuration allows the vertical shafts 23 and 25 to freely rotate within the guide sleeves 40, but restrains the vertical shafts 23 and 25 against lateral movement to and away from the central leg 20.

Similarly, a locking assembly 41 secures the lower portion of the vertical shafts 23 and 25 from lateral movement to and away from the central leg 20. In contrast to the guide sleeves, however, the locking assembly 41 is designed to prevent rotational movement of the vertical shafts 23 and 35 relative to the central leg 20 when the Christmas tree stand 10 is in the unfolded position. This, in turn, prevents relative rotation between the central leg 20 and the side legs 22 and 24. In this way, the side legs 22, 24 can be locked in the unfolded position when the tree stand 10 is supporting a Christmas tree 12. To achieve this, the locking assembly 41 comprises a series of tubular locking sleeves 42, 44, 54, and 56 that are co-axially disposed about the vertical shafts 23 and 25.

Considering now in more detail the structure of the components of the locking assembly 41, a first locking sleeve 42 is co-axially disposed about the vertical shaft 23 of the first side leg 22, below the guide sleeve 40, but above a second locking sleeve 44, wherein the second locking sleeve 44 is similarly disposed about the vertical shaft 23, below the first locking sleeve 42.

To lock the first side leg 22 against rotation relative to the central leg 20, the first locking sleeve 42 is fixedly attached to the vertical shaft 23, and the second locking sleeve 44 is fixedly attached to the vertical shaft 21 of the central leg 20. Further, the first locking sleeve 42 includes a locking tab 50 formed thereon that is received, i.e., interlocks into a locking slot 52 formed in the second locking sleeve 44. As seen in FIG. 2, a locking tab 50 so received, i.e. interlocked, prevents relative rotation between the first and second locking sleeves thereby preventing the first side leg 22 form pivoting relative to the central leg 20.

In further detail, the first locking sleeve 42 is so attached to the vertical shaft 23 by a plug weld 48 therein welding the first locking sleeve 42 to the vertical shaft 23 in a hole 46 radially drilled through the first locking sleeve 44, 42. Similarly, the second locking sleeve 44 is attached to the vertical shaft 21 of the central leg 20 by a fillet weld 36.

To permit rotation of the first side leg 22 relative to the central leg 20, a locking space 45 is provided so that the first locking sleeve 42 can be urged apart from the second locking sleeve 44 thereby removing the locking tab 50 from the locking slot 52. Accordingly, the first locking sleeve 42 no longer locks with the second locking sleeve 44, thus permitting relative pivotal movement between side leg 22 and the central 20.

Likewise, pivotal rotation of the second side leg 24 relative to the central leg 20 is prevented by a third locking sleeve 54 that is co-axially disposed about the vertical shaft 25 of the second side leg 24, below the guide sleeve 40, but above a fourth locking sleeve 56, wherein the fourth locking sleeve 56 is similarly disposed about the vertical shaft 25, below the third locking sleeve 54.

To lock the second side leg 24 against rotation relative to the central leg 20, the third locking sleeve 54 is fixedly attached to the vertical shaft 25, and the forth locking sleeve 56 is fixedly attached to the vertical shaft 21 of the central leg 20. Further, the third locking sleeve 54 includes a locking tab 50 formed thereon that is received, i.e., interlocks into a locking slot 52 formed in the fourth locking sleeve 56. As seen in FIG. 2, a locking tab 50 so received, i.e. interlocked, prevents relative rotation between the third and forth locking sleeves 54, 56 thereby preventing the second side leg 24 form pivoting relative to the central leg 20.

In further detail, the third locking sleeve 54 is so attached to the vertical shaft 25 by a plug weld 48 therein welding the third locking sleeve 54 to the vertical shaft 25 in a hole 46 radially drilled through the third locking sleeve 54. Similarly, the fourth locking sleeve is attached to the vertical shaft 21 of the central leg 20 by a fillet weld 36.

To permit rotation of the second side leg 24 relative to the central leg 20, a locking space 45 is provided so that the third locking sleeve 54 can be urged apart from the fourth locking sleeve 56 thereby removing the locking tab 50 from the locking slot 52. Accordingly, the third locking sleeve 54 no longer locks with the fourth locking sleeve 56, thus permitting relative pivotal movement between side leg 24 and the central 20.

A modification of the Christmas stand illustrated by FIG. 6 disclosed a Christmas tree stand 10 that has no locking tabs 50 or locking slots 52. In this modification, the fastener assembly 27, when fastened to a Christmas tree, serves to 14 prevent relative pivotal rotation, i.e., the fastener assembly 27, when fastened to or tree trunk 16, locks the legs against rotation relative to one another.

Beyond this, FIG. 7 illustrates the Christmas tree stand 10 in operation where a Christmas tree is releasably engaged with the Christmas tree stand 10, wherein the legs of the Christmas tree stand are arranged to permit one to place a water system 14 around the trunk 16 of the Christmas tree.

An alternate embodiment of the present invention is a Christmas Tree stand having legs that are pivotally fixed relative to each other. When the size of the Christmas tree, including a trunk 16 thereof, is extremely, large, safety precautions sometimes dictate that the legs on the stand be non-pivoting. When such is the case, a tree stand 10 as illustrated in FIG. 6 can be modified by welding sleeves 42 and 44 of the locking assembly 41 to together by a fillet weld 36. Similarly, sleeves 54 and 56 of the locking assembly 41 are welded together by a fillet weld 36. Additionally, guide sleeves 40 are welded to their respective shafts 23 and 25. Accordingly, the shafts 21, 23 and 25 of legs 20, 22 and 24, effectively, become one item, i.e., a non-folding Christmas tree stand.

Having illustrated and described the principles of my invention in a preferred embodiment thereof, it should be readily apparent to those skilled in the art that the invention can be modified in arrangement and detail without departing from such principles.

I claim all modifications coming within the spirit and scope of the accompanying claims:

1. A Christmas tree stand that is permanently assembled, yet is foldable, when unfolded it supports a Christmas tree in an upright position, and when folded it occupies a compact planar space for convenient handling, storage, and shipping, the Christmas tree stand comprising:

a central leg formed to define and lie wholly within a single plane, the central leg having a substantially vertical shaft disposed about a substantially vertical axis;

a first side leg formed to define and lie wholly within a single plane, the first side leg having a substantially vertical axis, wherein the shaft of the first side leg is disposed in parallel adjacent relation to the shaft of the central leg, and wherein the shaft of the first side leg is pivotally attached to the shaft of the central leg, thereby allowing the first side leg to pivot relative to the central leg;

a second side leg formed to define and lie wholly within a single plane, the second side leg having a substantially vertical shaft disposed about a substantially vertical axis, wherein the shaft of the second side leg is disposed in parallel adjacent relation to the shaft of the central leg, wherein the shaft of the second side leg is pivotally attached to the shaft of the central leg, thereby allowing the second side leg to pivot relative to the central leg;

a fastener assembly fixedly attached to one or more of the legs of the Christmas tree stand, the fastener assembly adapted to releasably engage the trunk of a tree;

a locking assembly disposed about the shafts of the first and second side legs, the locking assembly further comprising:

(a) a first sleeve having a substantially vertical axis, the first sleeve being co-axially disposed around the shaft of the first side leg, wherein a first sleeve so disposed is fixedly attached to the shaft of the first side leg;

(b) a second sleeve having a substantially vertical axis, the second sleeve being co-axially disposed around the shaft of the first side leg, vertically adjacent the first sleeve, wherein a second sleeve so disposed is fixedly attached to the shaft of the central leg, wherein the first sleeve interlocks with the second sleeve to prevent relative rotation between the first and second sleeves when the first sleeve is urged from a first unlocked position to a second locked position while the stand is in the unfolded position therein locking the first side leg against pivotal rotation relative to the central leg when the first side leg is in the unfolded position;

(c) a third sleeve having a substantially vertical axis, the third sleeve being co-axially disposed around the shaft of the second side leg, wherein a third sleeve so disposed is fixedly attached to the shaft of the second side leg; and (d) a fourth sleeve having a substantially vertical axis, the fourth sleeve being co-axially disposed around the shaft of the second side leg, vertically adjacent the third sleeve, wherein a fourth sleeve so disposed is fixedly attached to the shaft of the central leg, wherein the third sleeve interlocks with the fourth sleeve to prevent relative rotation between the third and fourth sleeves when the third sleeve is urged from a first unlocked position to a second locked position while the stand is in the unfolded position therein locking the second side leg against pivotal rotation relative to the central leg when the second side leg is in the unfolded position.

2. A foldable Christmas tree stand as recited in claim 1 wherein, the first and third locking sleeves have locking tabs formed thereon, and the second and fourth locking sleeves have locking slots formed therein, wherein the tab of the first locking sleeve is received by the slot of the second locking sleeve thereby causing the first and second locking sleeves to interlock, wherein the tab of the third locking sleeve is received by the slot of the fourth locking sleeve thereby causing the third and fourth locking sleeves to interlock, when the legs of the Christmas tree stand are in the unfolded position.

3. A foldable Christmas tree stand as recited in claim 2 wherein a cross section of the shaft of the first leg and of the shaft of the second leg is round.

4. A Christmas tree stand that is permanently assembled, yet is foldable, when unfolded it supports a Christmas tree in an upright position, and when folded it occupies a compact planar space for convenient handling, storage, and shipping, the Christmas tree stand comprising:

a central leg formed to define and lie wholly within a single plane, the central leg having a substantially vertical shaft disposed about a substantially vertical axis;

a first side leg formed to define and lie wholly within a single plane, the first side leg having a substantially vertical shaft disposed about a substantially vertical axis, wherein the shaft of the first side leg is disposed in parallel adjacent relation to the shaft of the central leg, and wherein the shaft of the first side leg is pivotally attached to the shaft of the central leg, thereby allowing the first side leg to pivot relative to the central leg;

a second side leg formed to define and lie wholly within a single plane, the second side leg having a substantially vertical shaft disposed about a substantially vertical axis, wherein the shaft of the second side leg is disposed in parallel adjacent relation to the shaft of the central leg, wherein the shaft of the second side leg is pivotally attached to the shaft of the central leg, thereby allowing the second side leg to pivot relative to the central leg;

a fastener assembly fixedly attached to one or more of the legs of the Christmas tree stand, the fastener assembly adapted for releasably engaging the trunk of a tree;

a locking assembly fixedly disposed about the shaft of the first side leg, the locking assembly having a first unlocked position and a second locked position, wherein the locking assembly locks the first side leg against pivotal rotation relative to the central leg when the first side leg is in the unfolded position;

a locking assembly fixedly disposed about the shaft of the second side leg, the locking assembly having a first unlocked position and a second locked position, wherein the locking assembly locks the second side leg against pivotal rotation relative to the central leg when the second side leg is in the unfolded position; and said fastener assembly further comprising a plurality of lugs fixedly attached to the first and second side legs of the Christmas tree stand, said lugs having holes formed therethrough, and a plurality of screws disposed through the holes, said screws adapted to engage the trunk of a Christmas tree to secure the same to the Christmas tree stand.

5. A Christmas tree stand that is permanently assembled, yet is foldable, when unfolded it supports a Christmas tree in an upright position, and when folded it occupies a compact space for convenient handling, storage, and shipping, the Christmas tree stand comprising:

a central leg having a substantially vertical shaft disposed about a substantially vertical axis;

a first side leg having a substantially vertical shaft disposed about a substantially vertical axis, wherein the shaft of the first side leg is disposed in parallel adjacent relation to the shaft of the central leg, the first side leg being movable from a folded position to an unfolded position;

a second side leg having a substantially vertical shaft disposed about a substantially vertical axis, wherein the shaft of the second side leg is disposed in parallel adjacent relation to the shaft of the central leg, the second side leg being movable from a folded position to an unfolded position;

fastening means attached to at least one leg of the Christmas tree stand, said fastening means adapted to releasably engage the trunk of a Christmas tree; and the legs of the Christmas tree stand being pivotally interconnected by a locking assembly that comprises:

a first elongate sleeve having a substantially vertical axis, the first sleeve being co-axially disposed around the shaft of the first side leg, wherein a first sleeve so disposed is fixedly attached to the shaft of the first side leg;

a second sleeve having a substantially vertical axis, the second sleeve being co-axially disposed around the shaft of the first side leg, vertically adjacent the first sleeve, wherein a second sleeve so disposed is fixedly attached to the shaft of the central leg, wherein the first sleeve interlocks with the second sleeve to prevent relative rotation between the first and second sleeves when the first sleeve is urged from a first unlocked position to a second locked position while the stand is in the unfolded position therein locking the first side leg against pivotal rotation relative to the central leg when the first side leg is in the unfolded position;

a third sleeve having a substantially vertical axis, the third sleeve being co-axially disposed around the shaft of the second side leg, wherein a third sleeve so disposed is fixedly attached to the shaft of the second side leg; and a fourth sleeve having a substantially vertical axis, the fourth sleeve being co-axially disposed around the shaft of the second side leg, vertically adjacent the third sleeve, wherein a fourth sleeve so disposed is fixedly attached to the shaft of the central leg, wherein the third sleeve interlocks with the fourth sleeve to prevent relative rotation between the third and fourth sleeves when the third sleeve is urged from a first unlocked position to a second locked position while the stand is in the unfolded position therein locking the second side leg against pivotal rotation relative to the central leg.

6. A foldable Christmas tree stand as recited in claim 5 wherein, the first and third locking sleeves have locking tabs formed thereon, and the second and fourth locking sleeves have locking slots formed therein, wherein the tab of the first locking sleeve is received by the slot of the second locking sleeve thereby causing the first and second locking sleeves to interlock, wherein the tab of the third locking sleeve is received by the slot of the fourth locking sleeve thereby causing the third and fourth locking sleeves to interlock, when the legs of the Christmas tree stand are in the unfolded position.

7. A Christmas tree stand that is permanently assembled, yet is foldable, when unfolded it supports a Christmas tree in an upright position, and when folded it occupies a compact space for convenient handling, storage, and shipping, the Christmas tree stand comprising:

a central leg having a substantially vertical shaft;

at least two side legs including a first side leg and a second side leg, each side leg having a substantially vertical shaft, wherein the shaft of each side leg is disposed in parallel adjacent relation to the shaft of the central leg, wherein the side legs are movable from a folded position to an unfolded position;

fastening means attached to at least one leg of the Christmas tree stand, said fastening means adapted to releasably engage the trunk of a Christmas tree; and the legs being pivotally interconnected by a locking assembly comprising:

a first elongate sleeve having a substantially vertical axis, the first sleeve being co-axially disposed around the shaft of the first side leg, wherein a first sleeve so disposed is fixedly attached to the shaft of the first side leg;

a second sleeve having a substantially vertical axis, the second sleeve being co-axially disposed around the shaft of the first side leg, vertically adjacent the first sleeve, wherein a second sleeve so disposed is fixedly attached to the shaft of the central leg, wherein the first sleeve interlocks with the second sleeve to prevent relative rotation between the first and second sleeves when the first sleeve is urged from a first unlocked position to a second locked position while the stand is in the unfolded position therein locking the first side leg against pivotal rotation relative to the central leg when the first side leg is in the unfolded position;

a third sleeve having a substantially vertical axis, the third sleeve being co-axially disposed around the shaft of the second side leg, wherein a third sleeve so disposed is fixedly attached to the shaft of the second side leg; and a fourth sleeve having a substantially vertical axis, the fourth sleeve being co-axially disposed around the shaft of the second side leg, vertically adjacent the third sleeve, wherein a fourth sleeve so disposed is fixedly attached to the shaft of the central leg, wherein the third sleeve interlocks with the fourth sleeve to prevent relative rotation between the third and fourth sleeves when the third sleeve is urged from a first unlocked position to a second locked position while the stand is in the unfolded position therein locking the second side leg against pivotal rotation relative to the central leg.

* * * * *